US011913122B2

(12) United States Patent
Lee et al.

(10) Patent No.: US 11,913,122 B2
(45) Date of Patent: Feb. 27, 2024

(54) SURFACE PATTERN FORMING METHOD FOR ALUMINIUM PRODUCT

(71) Applicant: Samsung Electronics Co., Ltd., Suwon-si (KR)

(72) Inventors: Kyunghwan Lee, Suwon-si (KR); Kwangjoo Kim, Suwon-si (KR); Jinju Kim, Suwon-si (KR); Jiyoung Song, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 17/108,280

(22) Filed: Dec. 1, 2020

(65) Prior Publication Data

US 2021/0164111 A1 Jun. 3, 2021

(30) Foreign Application Priority Data

Dec. 3, 2019 (KR) ..... 10-2019-0159338

(51) Int. Cl.
*C23F 1/02* (2006.01)
*C23F 17/00* (2006.01)
*C23F 1/36* (2006.01)

(52) U.S. Cl.
CPC ..... *C23F 1/02* (2013.01); *C23F 1/36* (2013.01); *C23F 17/00* (2013.01)

(58) Field of Classification Search
None
See application file for complete search history.

(56) References Cited

U.S. PATENT DOCUMENTS 3,314,869 A * 4/1967 Maddocks ..... C23F 1/02 361/779
2006/0138399 A1 6/2006 Itano et al.
2013/0017374 A1* 1/2013 Mionic ..... C09D 163/00 428/195.1
2013/0153428 A1* 6/2013 Akana ..... C25D 11/30 205/50
2014/0204608 A1* 7/2014 Park ..... G02B 6/0051 362/607
2018/0331245 A1* 11/2018 Gu ..... H01L 31/022433
2019/0121172 A1* 4/2019 Shigemura ..... G02F 1/133524

FOREIGN PATENT DOCUMENTS

CN 113522551 A * 10/2021
EP 2283171 A1 * 2/2011 ..... C23C 18/1601
EP 2 942 423 A1 11/2015
(Continued)

OTHER PUBLICATIONS

International Search Report dated Mar. 5, 2021, in corresponding International Patent Application No. PCT/KR2020/017440.
(Continued)

*Primary Examiner* — Allan W. Olsen
(74) *Attorney, Agent, or Firm* — STAAS & HALSEY LLP

(57) ABSTRACT

A pattern forming method is disclosed. The pattern forming method includes buffing a surface of a product containing aluminum, masking at least a part of the buffed surface with an etching resist, etching a part of the buffed surface not masked by the etching resist, removing the etching resist from the surface, and anodizing the surface from which the etching resist is removed.

1 Claim, 12 Drawing Sheets

(56) References Cited

FOREIGN PATENT DOCUMENTS

| | | | |
|---|---|---|---|
| JP | 3-253595 | A | 11/1991 |
| JP | 2014-41260 | | 3/2014 |
| KR | 10-2005-0058448 | | 6/2005 |
| KR | 10-2006-0060360 | A | 6/2006 |
| KR | 10-2009-0121816 | A | 11/2009 |
| KR | 10-2012-0045469 | | 5/2012 |
| KR | 10-2014-0084370 | A | 7/2014 |
| KR | 10-2014-0098172 | | 8/2014 |
| KR | 10-2015-0057071 | A | 5/2015 |
| KR | 10-1529888 | B1 | 6/2015 |
| KR | 10-2016-0091064 | A | 8/2016 |
| KR | 10-1754559 | B1 | 7/2017 |
| KR | 10-1794583 | | 11/2017 |
| KR | 10-1977807 | | 5/2019 |
| WO | 2013/095739 | A1 | 6/2013 |
| WO | WO 2014/030687 | A1 | 2/2014 |

OTHER PUBLICATIONS

Written Opinion of the International Searching Authority dated Mar. 5, 2021, in corresponding International Patent Application No. PCT/KR2020/017440.

Korean Office Action dated Oct. 12, 2022 in Korean Patent Application No. 10-2019-0159338 (5 pages; 6 pages English translation).

Office Action dated Feb. 8, 2023 in Korean Patent Application No. 10-2019-0159338 (4 pages; 4 pages English translation).

Office Action dated Sep. 2, 2023 in Korean Patent Application No. 10-2023-0107785.

* cited by examiner

| NaOH 10% ETCHING TIME | 2D | 3D | 3D CONTOUR | A VALUE (mm) | B VALUE (mm) | ETCHING DEPTH (μm) | SURFACE TEXTURE |
|---|---|---|---|---|---|---|---|
| 3 MINUTES |  |  |  | 0.923 | 0.077 | 21 | - |
| 5 MINUTES |  |  |  | 0.869 | 0.131 | 33 | EXCELLENT |
| 7 MINUTES |  |  |  | 0.810 | 0.190 | 38 | EXCELLENT |
| 9 MINUTES |  |  |  | 0.765 | 0.235 | 31 | EXCELLENT |

SURFACE PATTERN FORMING METHOD FOR ALUMINIUM PRODUCT

CROSS-REFERENCE TO RELATED APPLICATION

This application is based on and claims priority under 35 U.S.C. § 119 to Korean Patent Application No. 10-2019-0159338, filed on Dec. 3, 2019, in the Korean Intellectual Property Office, the disclosure of which is incorporated by reference herein in its entirety.

BACKGROUND

1. Field

The disclosure relates to a method for forming patterns on a surface of aluminum or an aluminum alloy. The disclosure more particularly relates to a low-cost and high efficient step of forming a surface pattern with both high gloss and mattness.

2. Description of Related Art

In the related art for forming a pattern on a surface of an aluminum product, generally anodizing was performed after physical processing such as sand blasting, hairline processing, and the like on an aluminum surface. However, in a case of the typical anodizing in the related art, the entire product is subjected to a sealing process after being immersed in a coloring dye dispersed on an aqueous solution after the anodizing, and accordingly, it was difficult to simultaneously realize different types of colors, different types of patterns, different types of glosses, and the like.

Meanwhile, in the related art, the following methods were used to realize different colors or different types of patterns on one surface.

In an example, a method for producing a sticker having a desired pattern or a text and attaching it to a surface was used, but a problem of detachment of the sticker occurred.

In an example, a method for performing a print process partially on an anodized surface was used, but, in a case of a surface already changed in a form of an oxide due to the anodizing, a problem of peeling of ink or the like occurred due to a deterioration in adhesiveness.

In an example, in a case of processing a two-dimensional or three-dimensional structure with patterns through machining, it was difficult to realize fine patterns due to a diameter of a tool and the cost increased as the pattern became complicated.

In an example, a method for forming a pattern by the machining an anodized surface and then forming a transparent coating was used, but there was a problem regarding the cost due to additional cost of machining and coating processing, and a color of a pattern in the machining was limited to gray which is a natural color of aluminum.

In an example, a method for realizing two colors by performing primary anodizing on a surface, performing masking and partial etching to form a pattern, performing secondary anodizing again, and removing the masking was used, but manual work was necessary in the final masking removing process which may lead an operator into a harmful working environment, and a problem regarding an increase in cost occurred due to the repetition of the anodizing.

In an example, a method for masking the entire surface, forming a pattern using a laser, and performing the anodizing was used, but it was inevitable that the surface is damaged due to the laser, and accordingly, the problem occurred that the color may be not good or white rust failure may occur in a corrosion environment.

Meanwhile, a method for performing machining after primary anodizing and then performing secondary anodizing has been disclosed, but in this case, a damage occurred on the primarily anodized surface at the time of the secondary anodizing, and accordingly it was practically difficult to realize a beautiful surface.

SUMMARY

The disclosure provides a pattern forming method with high productivity for realizing a beautiful appearance while reducing a cost, compared to the methods of the related art.

Specifically, the disclosure provides a pattern forming method for expressing both high gloss and mattness while reducing a cost by minimizing a number of times of anodizing.

The disclosure provides a pattern forming method for realizing a high gloss surface and matt surface with a three-dimensional effect thereby accurately expressing a difference in brightness of a color with only single anodizing.

In accordance with an aspect of the disclosure, there is provided a pattern forming method including buffing a surface of a product containing aluminum, masking at least a part of the buffed surface with an etching resist, etching a part of the buffed surface not masked by the etching resist, removing the etching resist from the surface, and anodizing the surface from which the etching resist is removed.

Solution

The buffing may include buffing the surface with high gloss.

The etching may include melting the part, not masked, by using an alkaline solution.

The removing may include peeling the etching resist off by performing ultrasonic immersion of the product masked with the etching resist using at least one of toluene, trichloroethane, ketone, and cyclohexanone.

The pattern forming method may further include cleaning the buffed surface, and the masking may include masking the cleaned surface by using the etching resist.

The cleaning may include degreasing the buffed surface at a high temperature, performing ultrasonic cleaning of the high-temperature degreased surface, and drying the ultrasonic-cleaned surface.

The anodizing may include performing degreasing, etching, desmutting, anodizing, coloring, sealing, and drying with respect to the surface in sequence.

The pattern forming method may include the anodizing only once.

A pattern of the product containing aluminum may be formed on the surface based on the etched part and non-etched part.

In accordance with another aspect of the disclosure, there is provided an aluminum product with a surface on which a pattern is formed by the pattern forming method according to various aspects described above.

The pattern forming method according to the disclosure is advantageous that high gloss and mattness may be simultaneously realized through steps with comparatively low cost.

In particular, the pattern forming method according to the disclosure is advantageous that a high gloss surface and a matt surface are realized with a three-dimensional effect thereby accurately expressing a difference in brightness of a color with only single anodizing.

BRIEF DESCRIPTION OF THE DRAWINGS

The above and other aspects, features, and advantages of certain embodiments of the present disclosure will be more apparent from the following detailed description taken in conjunction with the accompanying drawings, in which.

DETAILED DESCRIPTION

Figure 1:
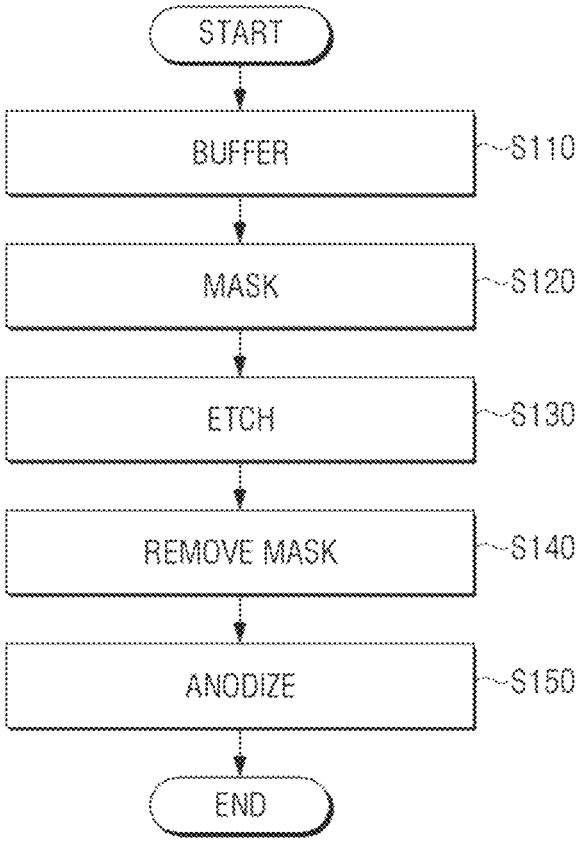
FIG. 1 is a flowchart for illustrating a pattern forming method according to an embodiment.

The disclosure will be described in detail after briefly explaining the way of describing the specification and the drawings.

The terms used in the specification and claims have been selected as general terms as possible in consideration of functions in the embodiments of the disclosure. But, these terms may vary in accordance with the intention of those skilled in the art, the precedent, technical interpretation, the emergence of new technologies and the like. In addition, there are also terms arbitrarily selected by the applicant. Such terms may be interpreted as meanings defined in this specification and may be interpreted based on general content of the specification and common technical knowledge of the technical field, if there are no specific term definitions.

The same reference numerals or symbols in the accompanying drawings in this specification denote parts or components executing substantially the same function. For convenience of description and understanding, the description will be made using the same reference numerals or symbols in different embodiments. That is, although the components with the same reference numerals are illustrated in the plurality of drawings, the plurality of drawings are not illustrating one embodiment.

In addition, terms including ordinals such as "first" or "second" may be used for distinguishing components in the specification and claims. Such ordinals are used for distinguishing the same or similar components and the terms should not be limitedly interpreted due to the use of ordinals. For example, in regard to components with such ordinals, usage order or arrangement order should not be limitedly interpreted with the numbers thereof. The ordinals may be interchanged, if necessary.

Unless otherwise defined specifically, a singular expression may encompass a plural expression. It is to be understood that the terms such as "comprise" or "consist of" are used herein to designate a presence of characteristic, number, step, operation, element, part, or a combination thereof, and not to preclude a presence or a possibility of adding one or more of other characteristics, numbers, steps, operations, elements, parts or a combination thereof.

In addition, in the embodiments of the disclosure, connection of a certain part to another part may include indirect connection via still another medium, in addition to direct connection. When it is described that a certain part includes another certain part, it implies that a still another part may be further included, rather than excluding it, unless otherwise noted.

Hereinafter, the disclosure will be described in detail with reference to the accompanying drawings.

FIG. 1 is a flowchart for illustrating a pattern forming method according to an embodiment.

The pattern forming method may refer to a method for forming a pattern on a surface of a product containing aluminum. The product containing aluminum may include, not only a product with a flat surface, but also a product with a three-dimensional surface. The product may be implemented in various forms such as a pipe, a plate, and the like made of aluminum or an aluminum alloy and may be implemented as a part of a home appliance such as a refrigerator, or other various products.

Referring to FIG. 1, in the pattern forming method, firstly, a surface of the product containing aluminum may be buffed (S110).

Specifically, the surface may be wet buffed by using buffing equipment to realize gloss or high gloss over the entire surface. A cleaning process may be performed with respect to the buffed surface.

At least a part of the buffed surface may be masked with an etching resist (S120). At that time, the masking may be performed so that a part of the surface to be finally expressed with high gloss is masked and a part to be finally expressed to be matt is not masked.

The part of the buffed surface not masked with the etching resist may be etched (S130).

Specifically, the surface part not masked with the etching resist may be etched using an alkaline solution containing caustic soda and a wetting agent. The masked part is not etched, because it is protected by the etching resist.

The etching resist may be removed from the surface (S140). At that time, the product masked with the etching resist may be subjected to ultrasonic immersion in a peeling solution to peel the etching resist off.

When the etching resist is removed, the anodizing may be performed with respect to the surface (S150). Specifically, the anodizing excluding a chemical polishing step may be performed, and as a result, a three-dimensional surface pattern including both a highly gloss part and matt part may be formed.

In the pattern forming method, the anodizing may be performed only once as a final step with respect to the surface including the pattern formed in the previous steps S110 to S140. As a result of the anodizing performed only once, the cost of the pattern forming step may be significantly reduced while forming the pattern including different types of colors (e.g., high gloss/mattness) at the same time.

In addition, since there is no need to perform additional steps after the anodizing, preservability of the formed pattern is very high.

Hereinafter, each of the steps described above will be described in more detail with reference to the drawings.

Figure 2:
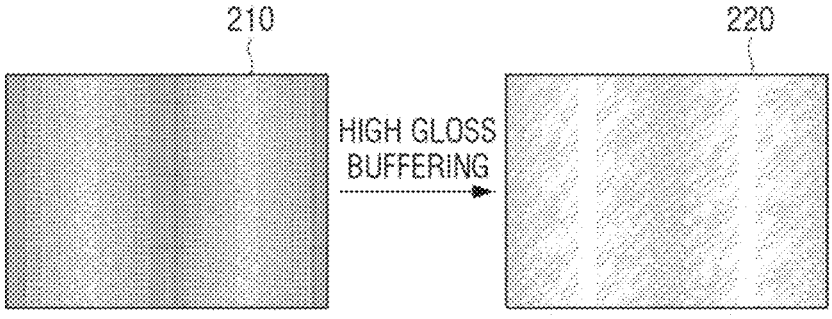
FIG. 2 is a diagram for illustrating an example of an aluminum product buffed with high gloss according to the pattern forming method according to an embodiment.

FIG. 2 is a diagram for illustrating an example of an aluminum product buffed with high gloss according to the pattern forming method according to an embodiment. A reference numeral 210 of FIG. 2 illustrates a surface of an aluminum pipe before performing the high gloss buffing and a reference numeral 220 of FIG. 2 illustrates the surface of the aluminum pipe after performing the high gloss buffing.

In the high gloss buffing step of the pattern forming method, wet buffing may be performed in sequence by using papers or the like with roughnesses different from each other. The buffing may be performed by using a first paper with a first roughness and then the buffing may be performed by using a second paper with a second roughness that is lower than the first roughness. After that, the buffing may also be performed by using a third paper with a third roughness that is lower than the second roughness.

As described above, the buffing may be performed by using a relatively rough paper (e.g., sand paper) at the initial stage and then the buffing may be performed by using a softer paper in sequence. As a result, the surface 220 having a lower roughness and higher gloss may be obtained, compared to the surface 210 that is obtained before the high gloss buffing.

In the pattern forming method, the surface buffed with high gloss may be cleaned. Each step of high-temperature degreasing, ultrasonic cleaning, and drying may be performed.

First, in the high-temperature degreasing step, organic/inorganic foreign materials of the surface may be removed through a degreasing solution containing a sulfuric acid or caustic soda. Specifically, the surface may be immersed in the degreasing solution with pH of 5 to 9 at approximately 60° C. for shorter than 600 seconds. However, there is no limitation thereto, and various methods disclosed in the related art may be used.

In the ultrasonic cleaning step, specifically, the surface of the product may be subjected to ultrasonic cleaning with an ion exchange water or a distilled water with pH of 6.5 to 7.5 at approximately room temperature for 60 seconds or longer.

The drying step is a process for removing moisture generated on the surface during the high-temperature degreasing or the ultrasonic cleaning process, and for example, the surface may be dried with hot air at 90° C. or lower for approximately 300 to 600 seconds.

In the pattern forming method, at least a part of the surface may be masked with the etching resist in order to partially etch the surface along the pattern to be formed. The etching resist may be made of various materials such as an organic material, an inorganic material, a metal, and the like.

In detail, at least a part of the surface may be masked with the etching resist by a PAD printing method, a silk screen printing method, a photoresist method, an offset printing method, and the like. Meanwhile, various other masking methods disclosed in the related art may be used.

In a case of using the silk screen printing method, a part of the surface may be masked with a carbon containing masking solution and a hardening temperature at that time may be 80° C. to 90° C. and hardening time may be approximately 30 to 60 minutes.

Figure 3A:
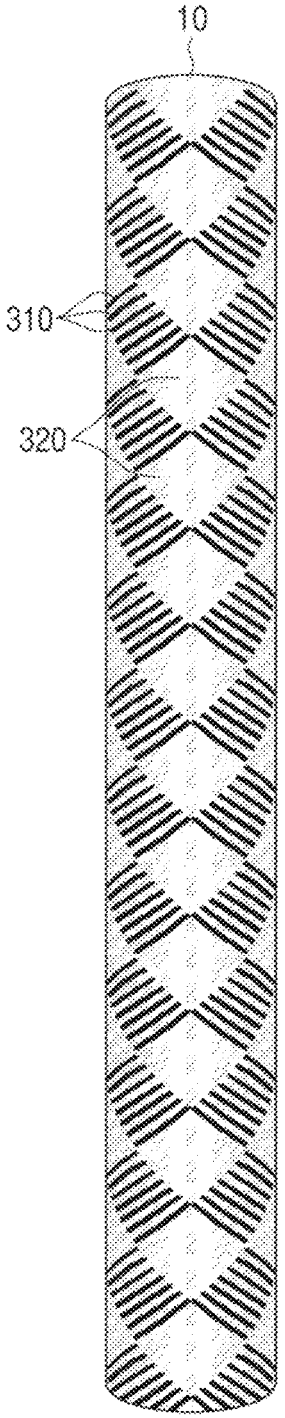
FIGS. 3A and 3B are diagrams for illustrating an example of an aluminum product masked according to the pattern forming method according to an embodiment.
Figure 3B:
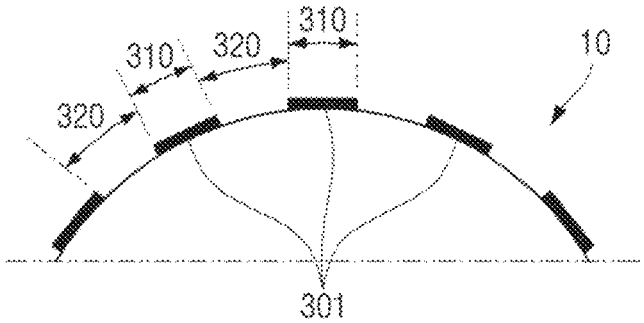

FIGS. 3A and 3B are diagrams for illustrating an example of an aluminum product masked according to the pattern forming method according to an embodiment.

FIG. 3A illustrates an aluminum product 10 to which an etching resist is applied. The surface of the product 10 may be divided into a part 310 to which the etching resist is applied and a part 320 to which the etching resist is not applied.

FIG. 3B illustrates a close view schematically illustrating a part of a surface partially masked seen in a side direction.

Referring to FIG. 3B, it may be confirmed that the partial surface part 310 is masked with an etching resist 301 and the other surface part 320 is not masked.

In the pattern forming method, the partially masked surface may be partially etched by using an etching solution.

In detail, at least a part of the surface may be etched using an alkaline solution at a temperature of 50° C. to 60° C. for approximately 300 seconds. The alkaline solution may be a solution containing 8 to 12 mass % of NaOH and 1 mass % of a wetting agent but there is no limitation thereto.

Figure 4A:
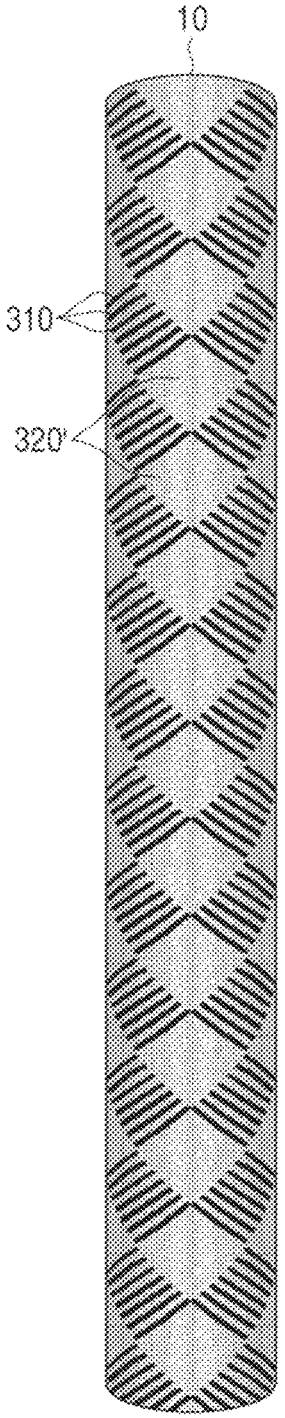
FIGS. 4A to 4C are diagrams for illustrating an example of an aluminum product etched according to the pattern forming method according to an embodiment.
Figure 4B:
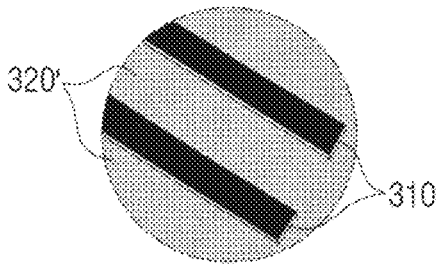
Figure 4C:
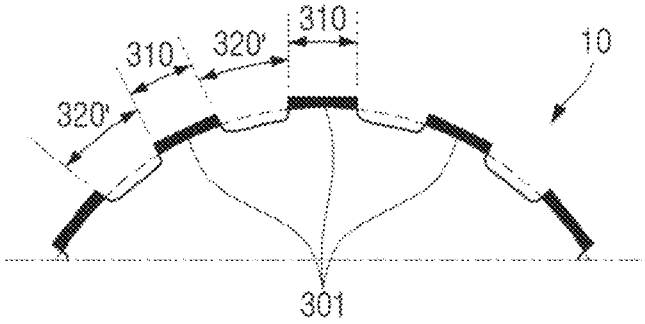

FIGS. 4A to 4C are diagrams for illustrating an example of an aluminum product etched according to the pattern forming method according to an embodiment.

Referring to FIG. 4A illustrating the product 10 and FIG. 4B illustrating an enlarged surface of the product 10, as a result of the etching, the gloss of the surface part 320 that maintained the gloss in the past may be removed to obtain a matt surface part 320'.

Referring to FIG. 4C, the masked surface part 310 is not etched by the etching solution, but the part 320 not masked is etched in a depth direction of the surface. As a result, a three-dimensional pattern may be formed on the surface of the product 10 while forming the matt surface part 320'.

Figure 5:
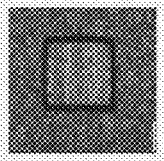
FIG. 5 is a diagram for illustrating a three-dimensional effect of a surface over etching time using images and values according to an embodiment.
Figure 5:
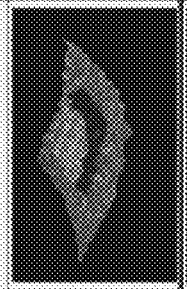
Figure 5:
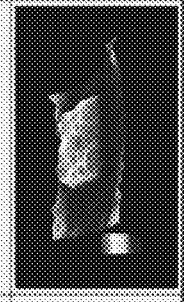
Figure 5:
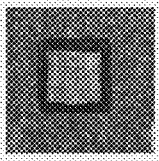
Figure 5:
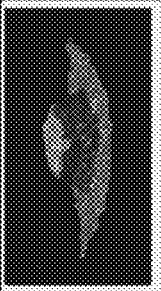
Figure 5:
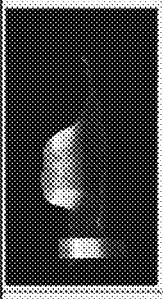
Figure 5:
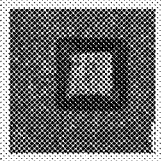
Figure 5:
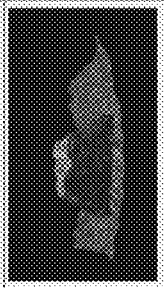
Figure 5:
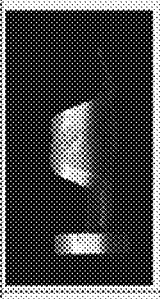
Figure 5:
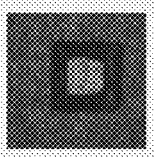
Figure 5:
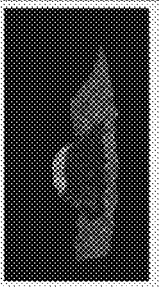
Figure 5:
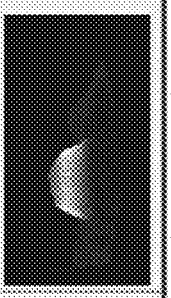
Figure 5:
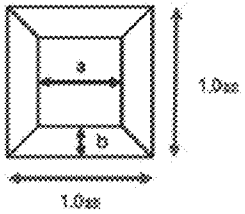

FIG. 5 is a diagram for illustrating a three-dimensional effect of a surface over etching time using images and values according to an embodiment. FIG. 5 is premised on that the surface is etched by an alkali solution containing 10 mass % of NaOH in a state where an area of the surface having a width of 1.0 mm and a height of 1.0 mm is masked.

FIG. 5 illustrates 2D/3D images, 3D contours, and the like of the surface over the etching time after the masking. In FIG. 5, "a" is a width in a masking direction of the surface seen from the top, and "b" is a width of a tilt area in the middle of the masked part and the non-masked part seen from the top. An etching depth may refer to a difference in depth (height) between the masked part and the non-masked part.

Mostly, as the etching depth and the "b" value increase, three-dimensional sensation is improved. Therefore, when the etching depth is 30 μm or more and the "b" value is 0.1 mm or more, the three-dimensional sensation is realized in an excellent manner.

In other words, when using the alkaline solution containing 10 mass % of NaOH, the excellent surface texture may be realized, if the etching time is 5 minutes or longer. Specifically, the etching time of 5 minutes to 9 minutes may be suitable.

In the pattern forming method, the etching resist attached to the etched surface may be removed. Specifically, the product 10 masked with the etching resist may be subjected to the ultrasonic immersion process using at least one of toluene, trichloroethane, ketone, and cyclohexanone to peel the etching resist off.

Figure 6A:
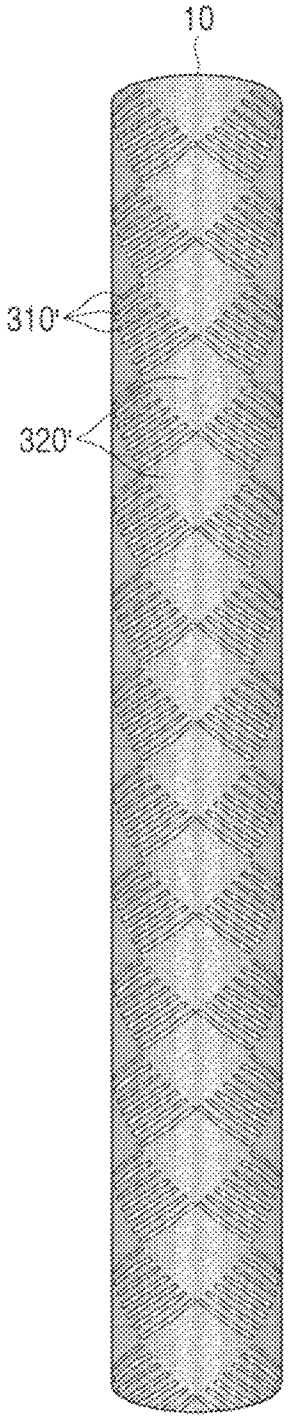
FIGS. 6A to 6C are diagrams for illustrating an example of an aluminum product subjected to masking removal according to the pattern forming method according to an embodiment.
Figure 6B:
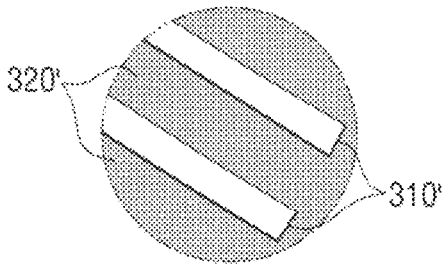
Figure 6C:
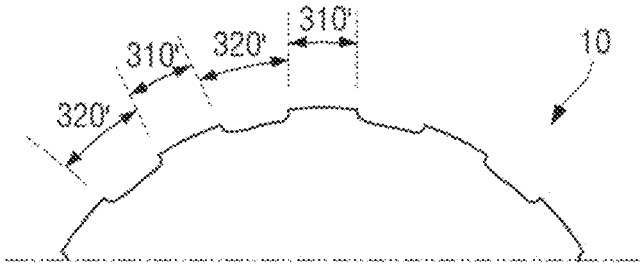

FIGS. 6A to 6C are diagrams for illustrating an example of an aluminum product subjected to masking removal according to the pattern forming method according to an embodiment.

Referring to FIG. 6A illustrating the product 10, from which the etching resist is removed, and FIG. 6B illustrating the enlarged surface of the product 10 of FIG. 6A, it may be confirmed that the gloss state of a surface part 310', from which the etching resist is removed, is substantially maintained as it is, compared to the state immediately after the high gloss buffing.

In relation to this, FIG. 6C illustrates a close view schematically illustrating the surface, from which the etching resist 301 is removed, in a side direction. Referring to FIG. 6C, the high gloss surface part 310' and a matt surface part 320' may coexist on the surface and a three-dimensional pattern may be realized with a difference in depth between the high gloss surface part 310' and the matt surface part 320'.

As a result, it is possible to realize a three-dimensional/multi-colored pattern in which the high gloss surface part 310' and the matt surface part 320' are distinguished.

In the pattern forming method, finally, the anodizing may be performed once.

Figure 7:
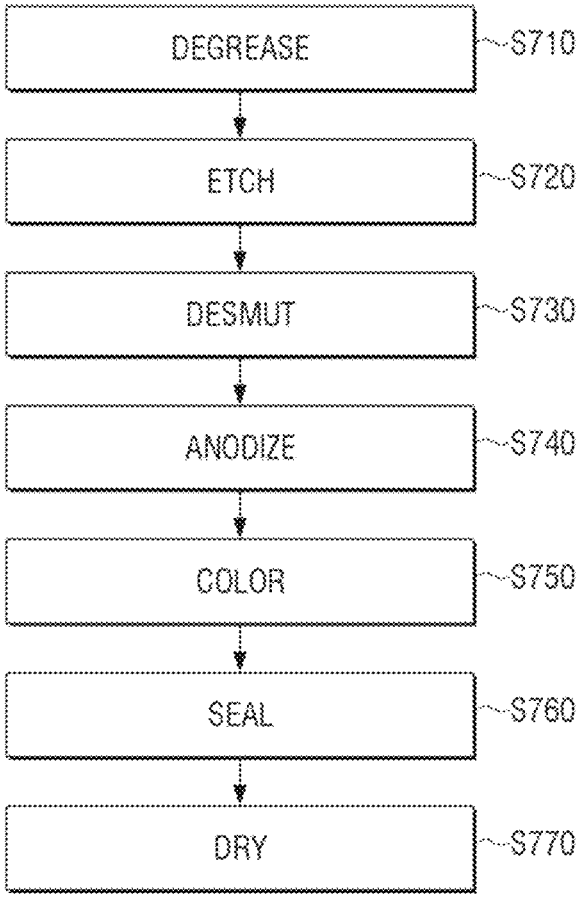
FIG. 7 is a flowchart for specifically illustrating an example of performing anodizing by the pattern forming method according to an embodiment.

FIG. 7 is a flowchart for specifically illustrating an example of performing anodizing (S150) by the pattern forming method according to an embodiment.

Referring to FIG. 7, first, degreasing may be performed (S710). Specifically, the surface may be cleaned with a degreasing solution containing a sulfuric acid or caustic soda.

The surface may be cleaned with the degreasing solution at a temperature of 30° C. to 60° C. for approximately 60 to 120 seconds.

Then, etching may be performed (S720). This process is completely different from the etching step S130 described above of forming the surface pattern three-dimensionally and partially removing the gloss, and is merely for removing the foreign materials on the surface of the product 10 or in the product 10. Specifically, the product 10 may be immersed in a NaOH solution (less than 5 mass %) at approximately 50° C. for shorter than 10 seconds.

Desmutting for removing inorganic impurities on the surface may be performed (S730). Specifically, the product 10 may be immersed in a desmutting dedicated solution containing a nitric acid, permanganic acid, or the like for approximately shorter than 60 seconds.

Then, the anodizing may be proceeded (S740). For this, the product 10 may be immersed in a sulfuric acid ($H_2SO_4$) solution (18 to 20 mass %) at a temperature of approximately 18° C. to 23° C. and a current at a voltage of approximately 13 to 18 V may be supplied. When this state is maintained for 600 seconds or longer, the surface may be anodized. However, fine pores may be generated on the surface. This is a specific example for proceeding the anodizing and the anodizing process is not limited to this example.

Then, coloring may be proceeded with respect to the surface (S750). Specifically, the product 10 may be immersed in a dye solution with pH of 5.8 to 6.0 at approximately 50° C. for shorter than 600 seconds. However, the suitable pH and temperature my vary depending on substances contained in the dye solution.

The colored surface may be sealed (S760). Specifically, the product 10 may be immersed in a sealing agent (e.g., solution with 3 to 5 mass % of nickel acetate) at a temperature of approximately 85° C. to 95° C. for longer than 300 seconds, but there is no limitation. As a result of the sealing, fine pores may be sealed while preventing decolorization.

Finally, drying may be performed to remove surface moisture (S770). Specifically, the surface moisture may be removed with hot air at 90° C. or lower for approximately 300 to 600 seconds.

As a result, it is possible to finish the aluminum product having a three-dimensional pattern with both high gloss and mattness.

As described above, in the pattern forming method of the disclosure, it is possible to realize both high gloss and matt patterns or letters on the surface and form a three-dimensional pattern with a difference in depth between a etched part and an unetched part through partial etching process.

In addition, in the pattern forming method, it is possible to provide a multicolor effect using a difference in brightness of color by performing the anodizing only once.

Further, in the pattern forming method, the effects of high productivity and cost reduction are exhibited compared to multiple anodizing, machining, laser processing, and the like of the related art.

While preferred embodiments of the disclosure have been shown and described, the pattern forming method according to the disclosure is not limited to the aforementioned specific embodiments, and it is apparent that various modifications can be made by those having ordinary skill in the technical field to which the disclosure belongs, without departing from the gist of the disclosure as claimed by the appended claims. Also, it is intended that such modifications are not to be interpreted independently from the technical idea or prospect of the disclosure.

What is claimed is:

1. A pattern forming method comprising:

buffing, to a gloss, the surface of an aluminum-containing product, with a wet buffing method;

degreasing the buffed surface;

performing ultrasonic cleaning of the degreased surface;

drying the ultrasonic-cleaned surface;

masking at least a part of the dried surface with an etching resist based on a silk screen printing method;

etching a part of the buffed surface not masked by using an alkaline solution during a predetermined time within 5 minutes to 9 minutes;

forming a high gloss part corresponding to a part of the buffed surface masked, and a matted part corresponding to a part of the buffed surface not masked on the surface, by removing the etching resist from the surface; and anodizing the surface from which the etching resist is removed, wherein the part of the buffed surface not masked is etched to a depth of 30 μm or more, and wherein the predetermined time is varied based on a width of a masked part or the depth to obtain by etching, and wherein the buffing comprises buffing the surface of the product by using a first paper with a first roughness, and buffing the surface of the product by using a second paper with a second roughness that is lower than the first roughness, and buffing the surface of the product by using a third paper with a third roughness that is lower than the second roughness, and wherein the removing comprises peeling the etching resist off by performing ultrasonic immersion of the product masked with the etching resist using at least one of toluene, trichloroethane, and a ketone, and wherein the anodizing comprises performing, in sequence, degreasing, etching, desmutting by immersing the product in desmutting dedicated solution containing a nitric acid, or permanganic acid, passing a current through the product containing aluminum, coloring, sealing, and drying by removing moisture from the surface with air having a temperature of 90° C. or lower.

* * * * *